United States Patent [19]

Mayea

[11] 4,289,267

[45] Sep. 15, 1981

[54] EIGHT-SIDED PREFABRICATED CONTAINER HAVING AN AUTOMATIC BOTTOM

[75] Inventor: Larry Mayea, New York, N.Y.

[73] Assignee: Arkay Packaging Corporation, New York, N.Y.

[21] Appl. No.: 145,630

[22] Filed: May 1, 1980

[51] Int. Cl.[3] ..... B65D 5/10; B65D 5/36

[52] U.S. Cl. ..... 229/39 R; 229/41 C

[58] Field of Search ..... 229/41 C, 39 R

[56] References Cited

U.S. PATENT DOCUMENTS

| | | | |
|---|---|---|---|
| 1,425,549 | 8/1922 | Scruby | 229/41 C UX |
| 2,285,174 | 6/1942 | Simons | 229/41 C UX |
| 2,695,525 | 11/1953 | Wikstrom | 229/41 C |
| 3,174,675 | 3/1965 | Rosenburg, Jr. | 229/41 C |
| 3,526,352 | 9/1970 | Swett | 229/39 R |
| 3,768,720 | 10/1973 | Bundy | 229/41 C |
| 3,907,194 | 9/1975 | Davenport et al. | 229/39 R |
| 3,977,594 | 8/1976 | Swam | 229/39 R |

*Primary Examiner*—Davis T. Moorhead

[57] ABSTRACT

An eight-sided foldable container having a bottom of the glued-automatic variety is disclosed. The container is constructed from a single sheet of foldable material which comprises eight side panels, a plurality of which are provided with bottom panels which extend angularly downwardly from the side panels via fold lines. These bottom panels are folded inwardly at their respective fold lines toward the center of the formed container such that two pairs are bonded together so as to enable the remaining bottom panels to interlock with and be supported by said bonded bottom panels, thereby forming a container bottom capable of supporting substantial weight, as well as being folded to a relatively flat condition. The blanks used for the construction of the container are also disclosed.

9 Claims, 5 Drawing Figures

EIGHT-SIDED PREFABRICATED CONTAINER HAVING AN AUTOMATIC BOTTOM

BACKGROUND OF THE INVENTION

This invention relates to containers. More particularly, it relates to a container having eight vertical sidewalls and a glued-automatic type bottom. The invention further relates to the blanks used to make such containers.

A variety of containers that are presently in use are formed from one or more paperboard blanks that are divided by fold lines into a plurality of side panels. This type of container has attained a great popularity because it may be provided with varying number of sides, it is relatively inexpensive to produce, and takes little storage space in its folded condition. In addition, it can easily be made attractive by, for example, decorative printing and provides adequate protection for many types of articles.

Most containers of this type, however, are provided with a bottom formed by a single panel that is joined to a side panel along a folded line. The drawback of this type of bottom is that it has a tendency to "push out" when the contents of the container is relatively heavy. The problem of "pushing out" has partially been eliminated by the development of the well known glued-automatic bottom type of container. This type of bottom is utilized when the container is intended for packaging relatively heavy objects, such as bottles of liquid. The automatic bottom comprises a number of bottom panels which are connected to each of the side panels of the container by fold lines. During construction various bottom panels are glued, or otherwise bound to each other, such that the combination of bonded and folded bottom panels interlock with each other to form the bottom of the container.

Unlike the simple folded bottom initially described above, the automatic bottom does not require any manipulative steps on the part of the user to form the bottom of the container; rather, the bottom is automatically formed when the container is opened to its full form.

Although the automatic bottom has solved the problem encountered when packaging heavy items, it has not been possible to date to develop an eight-sided container provided with an automatic type bottom. The need for an eight-sided container which is provided with a bottom capable of supporting considerable weight is well known, particularly in the liquor industry, where the need for a container to conform as closely to a round bottle is needed to conserve space on the shelf as well as during shipment.

SUMMARY OF THE INVENTION

The present invention relates to an eight-sided foldable container having a bottom of the automatic variety and the blanks used to make such a container. According to the present disclosure, the container of the present invention is constructed from a single sheet of folded material which comprises eight side panels, a plurality of which are provided with bottom panels which extend angularly downwardly from the side panels via fold lines. These bottom panels are adapted to be folded inwardly at their respective fold lines toward the center of the formed container. Subsequent to the inwardly folding of the bottom panels, two pairs of the bottom panels are permanently bound to each other in such a manner as to enable the remaining bottom panels to interlock with and be supported by said bonded bottom panels, thereby forming a container bottom capable of supporting substantial weight, as well as being folded to a relatively flat condition.

The container described above can be made from a single integrally formed blank. This blank is another aspect of the invention. It comprises eight side panels, a plurality of which are provided with bottom panels which extend angularly downwardly from the side panels via fold lines.

Accordingly, it is an object of the present invention to provide an eight-sided container with an automatic bottom.

Another object of the invention is to provide a container which is easy to assemble and economic to produce.

Still another object of the present invention is to provide a single blank adapted to form an eight-sided container having an automatic bottom.

Still other objects and advantages of the present invention will be obvious, and in part be apparent from the specification and attached drawings.

DESCRIPTION OF THE DRAWINGS

For a fuller understanding of the invention reference is had to the following description taken in connection with the accompanying drawings of the preferred embodiment in which.

DESCRIPTION OF THE PREFERRED EMBODIMENT

Figure 1:
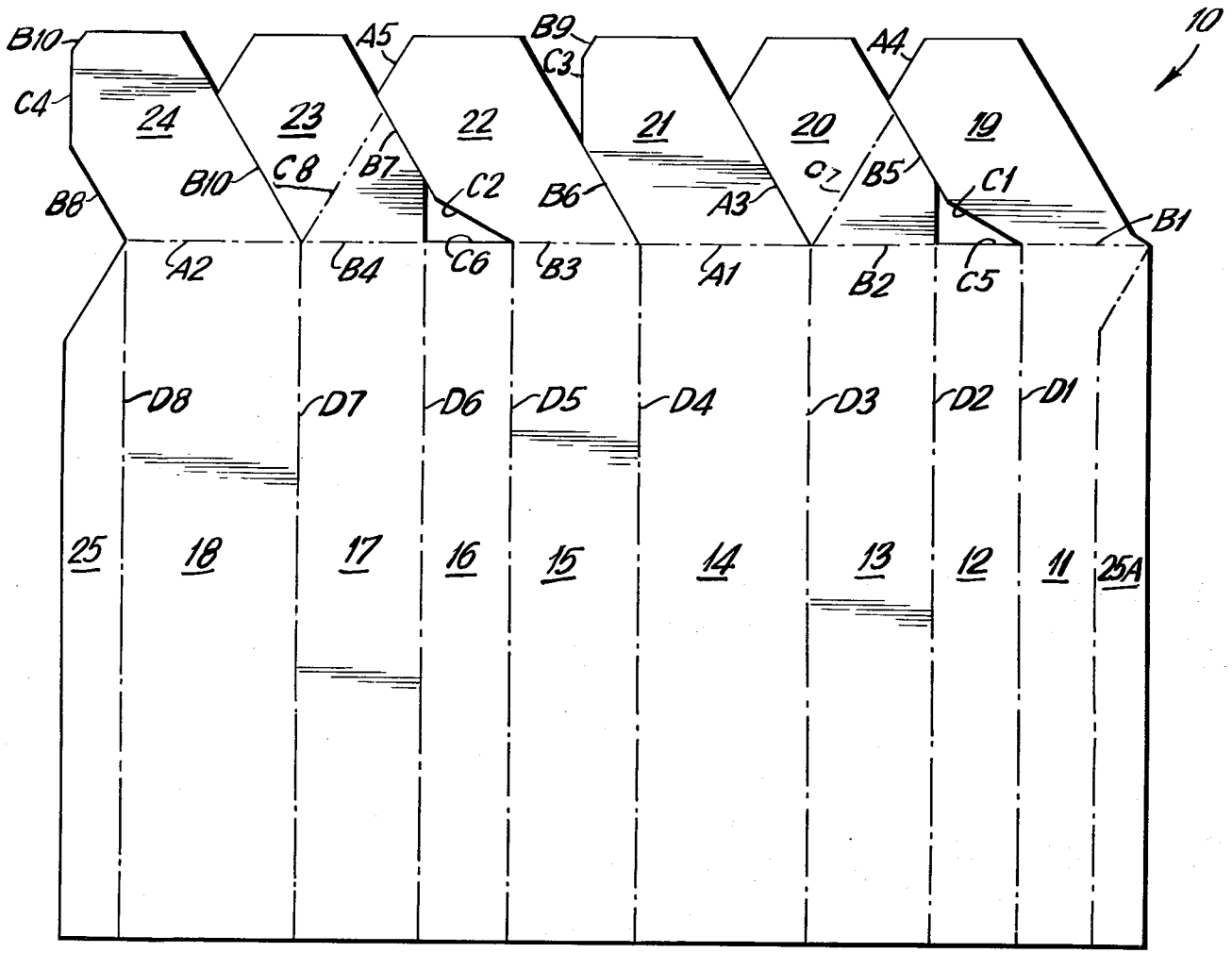
FIG. 1 shows an unfolded blank constructed in accordance with the invention from which a container can be made.

As shown in the drawings, the present invention comprises a blank having a plurality of panels and folds, each panel being adapted to selectively cooperate with each other to form an eight-sided container having an automatic bottom.

Referring now more particularly to the accompanying drawings wherein like numbers designate similar parts throughout the various views, attention is directed to FIG. 1 wherein the blank of the present invention is designated generally by reference number 10. Blank 10 included a plurality of vertical side panels 11, 12, 13, 14, 15, 16, 17 and 18 and a plurality of bottom panels 19, 20, 21, 22, 23 and 24, extending from each of the side panels 11 to 18 respectively. The plurality of bottom panels are joined to the side panels by fold lines designated by dashed lines B1, B2, A1, B3, B4 and A2. Likewise, side panels 11 to 18 are joined by fold lines D1 to D7 respectively.

Blank 10 is also provided with tab 25 which is connected to side panel 18 by means of fold D8. Tab 25 is adapted to be glued or otherwise fastened to the inner surface of side panel 11 when blank 10 is folded to form a container.

In referring to FIG. 1 it is to be understood that the surface of the panels being viewed will form the inner walls of the assembled container. In other words in the formation of the container the side panels will be folded along fold lines in such a manner that they will be brought out of the plane of the paper and toward the reader. Likewise, bottom panels 19 to 24 will be folded along folds B1, B2, A1, B3, B4 and A2 away from the plane of the paper toward the reader.

Figure 2:
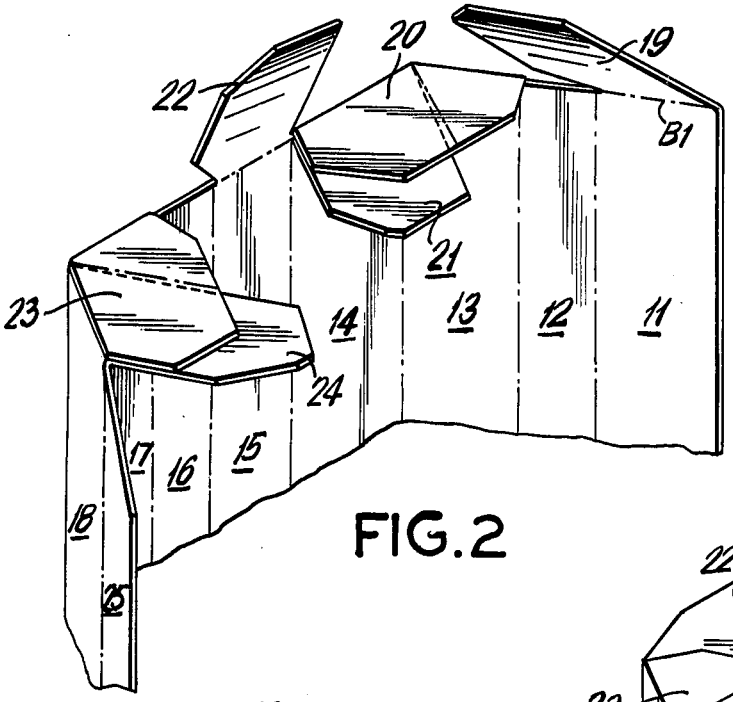
FIG. 2 is a pictorial three-dimensional representation of a container in a first partially assembled condition.

In assembling the container of the present invention using the blank depicited in FIG. 1, bottom panels 20 and 21 are folded along fold lines B2 and A1 respectively, such that they are perpendicular to the plane of panels 13 and 14. Side panel 13 is then folded toward panel 14 along fold line D3 such that side A3 of bottom panel 20 contacts the outer side of fold A1 as shown in FIG. 2. The inner side of bottom panel 20 is then glued, or otherwise bound, to the outer surface of bottom panel 21. As further shown in FIG. 2 the angle, which exists between edge A3 of bottom panel 20 and fold lines B2 and A1, will ultimately dictate the angle between side panels 13 and 14 when the container is in its assembled and erected condition.

In like manner bottom panels 23 and 24 are folded at right angles to side panels 17 and 18 respectively, and said side panels are folded along fold line D7 such that edge B10 of bottom panel 23 contacts the outer portion of fold A2, as also shown in FIG. 2. Bottom panel 23 is then fastened to bottom portion 24.

Figure 3:
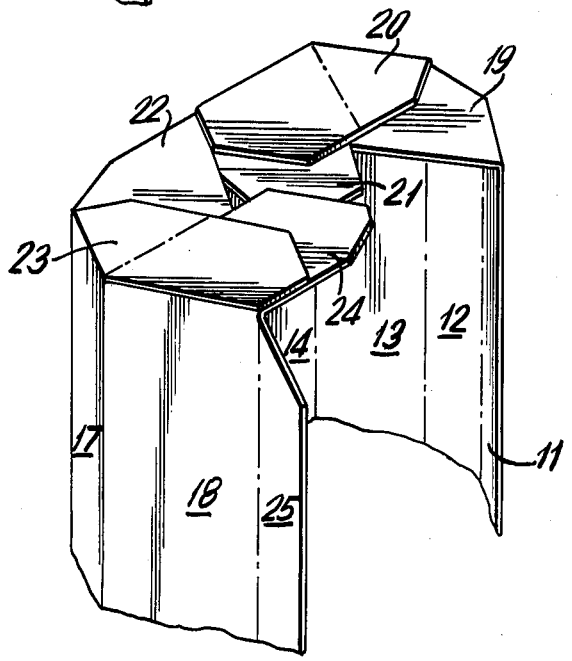
FIG. 3 is a pictorial three-dimensional representation of a container made from the blank of FIG. 1 in a second partially assembled condition.

Bottom panels 19 and 22 are then folded along fold lines B1 and B3 such that they are beneath the horizontal plane of bonded bottom panels 20–21 and 23–24, as shown in FIG. 3. Side panels 11 and 12 are then brought toward side panel 13 by folding along fold lines D1 and D2 until edges C1, B5 and A4 of bottom panel 19 contact edge C5 of side panel 12 and the inner portion of fold B2 and A1 respectively. It can be seen that the angular relationship which exists between fold line B1, edges C1, B5 and A4 determines the angular relationship which will exist between side panels 11, 12, 13 and 14 when the container is in the erected condition.

Side panels 16 and 17 are then brought toward side panel 15 by folding along fold lines D5 and D6, such that edges C2, B7, and A5 of bottom panel 22 contact edge C6 and the inner portions of fold lines B4 and A2 respectively. As with bottom panel 19, the angular relationship which exists between fold B3, edges C2, B7 and A5 of bottom panel 22 determines the angular relationship which will exist between side panels 15, 16, 17 and 18 when the container is in the erected condition.

Side panels 14 and 15 are then brought toward each other by folding along fold line D4, such that edges B8, C4 and B10 contact the inner portion of folds B1, C5 and B2 respectively, and edges B6, C3 and B9 of bottom panel 21 contact inner folds B3, C6 and B4 respectively. Tab 25 is then glued to the inner side portion 25A of side panel 11.

Figure 4:
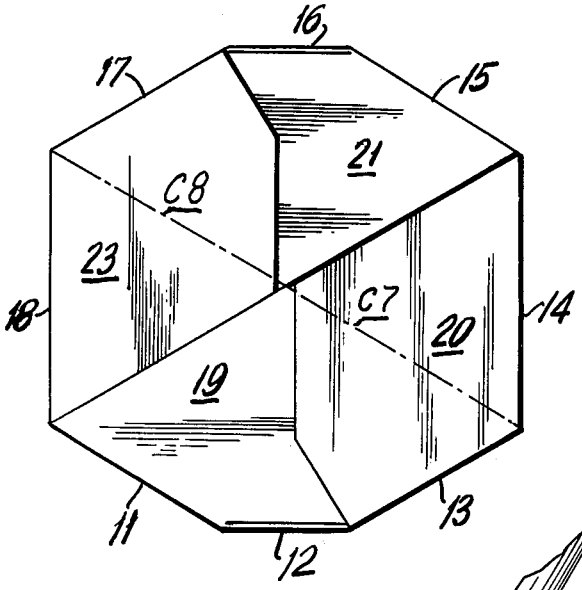
FIG. 4 is a plane view of the bottom of the container constructed using the blank depicted in FIG. 1.
Figure 5:
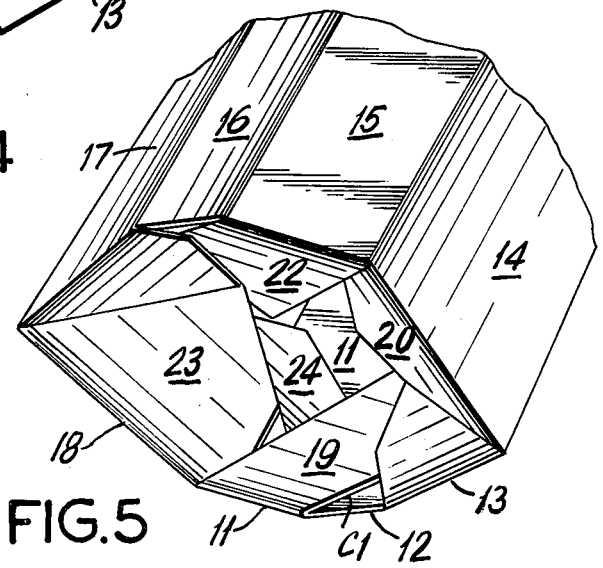
FIG. 5 is a pictorial three-dimensional representation of the bottom of the container in a partially collapsed condition.

FIG. 4 depicts the bottom of the container in the assembled position. Note that once assembled the container may easily be collapsed for storage by simply pushing in the bottom. This has the effect of folding bottom panels 20 and 23 along fold lines C7 and C8. Since bottom panels 19 and 22 are in no way fixed to the other bottom panels, they are free to simply fold back onto the inside surfaces of the side panels as depicted in FIG. 5. In order to open the container to its fully extended position, it is only necessary to push the automatic bottom out from the inside.

Although the blank and the container of the present invention is shown and described as not having any top portion thereon, it is understood that any variety of lid extension may be adapted to the upper edge 26 of blank 10 to enclose said container.

Furthermore, the present invention has been disclosed and described as being constructed of cardboard or the like, however, one should keep in mind that any number of flexible materials which may be bent and cut into the appropriate form may be used.

In addition, although side panels 4 to 18 have been depicted as having certain widths relative to each other, it is understood that they may be varied to form containers having various configurations using eight sides.

Since from the foregoing, the construction and advantage of the container and blank may be readily understood, further explanation is believed unnecessary. However, since numerous modifications will readily occur to those skilled in the art after a consideration of the foregoing specification and accompanying drawings, it is not intended that the invention be limited to the exact construction shown and described, but all suitable modifications and equivalents may be resorted to which fall within the scope of the appended claims. Having described the invention,

What I claim is:

1. An eight-sided container comprising at least one sheet of flexible material, said flexible being divided by fold lines into eight-side panels, said fold lines being positioned such that when the terminal ends of said flexible material are secured together, said flexible material forms a tubular wall structure having eight sides; a collapsible end structure, comprising a plurality of six flaps hingedly extending from one end of a plurality of the side panels at an angular relationship thereto, a first and second pair of said flaps extending from a first and second pair of side panels which are oppositely deposed from each other when said container is in an erected position, the first flap of said first and second pairs of flaps being fixably attached to the second flap of said first and second pair of flaps, said flaps being adapted to interlock with each other to form a bottom portion of said eight-sided container when said container is opened to an erected position without the need for any additional manipulative steps, wherein said bottom portion is capable of being collapsed to a flat position within said container when said container is in a storage position.

2. The container of claim 1, wherein the container is made from one integrally formed blank divided by fold lines.

3. The container of claim 1, wherein the eight-side panels are of equal size.

4. The container of claim 3, wherein one of the side panels is provided with a tab to facilitate the attachment of one side panel to another side panel to form a continuous arrangement of side panels.

5. The container of claim 4, wherein the flexible material is paperboard.

6. A blank for forming an eight-sided container comprising at least one sheet of flexible material, said blank being divided by a plurality of fold lines into eight-side panels, said fold lines being positioned such that wwhen the terminal ends of the blank are secured together, said flexible material forms a tubular wall structure having eight sides, said blank further comprising a plurality of six flaps which hingedly extend from the end of six of the eight-side panels at an angular relationship thereto, a first and second pair of said flaps extending from a first and second pair of side panels which are oppositely deposed from each other when the container is in an erected position, the first flap of said first and second pairs of flaps being adapted to be fixably attached to the second flap of said first and second pair of flaps when said blank is in an erected position, said fixably attached flaps being adapted to interlock with each other to form a bottom portion of the eight-sided container when the terminal ends of the blank are secured together to form the tubular wall structure having eight sides, wherein said bottom portion so formed is capable of being collapsed to a flat position within said container when said container is in a storage position.

7. The blank of claim 6, wherein the eight-side panels are of equal size.

8. The blank of claim 6, wherein one of the side panels is provided with a tab to facilitate the attachment of one side panel to another side panel to form a continuous arrangement of side panels when the blank is erected to form a container.

9. The blank of claim 6, wherein the flexible material is paperboard.

* * * * *